US005606332A

United States Patent [19]

Darden, IV et al.

[11] Patent Number: 5,606,332

[45] Date of Patent: Feb. 25, 1997

[54] DUAL FUNCTION ANTENNA STRUCTURE AND A PORTABLE RADIO HAVING SAME

[75] Inventors: William H. Darden, IV, Libertyville, Ill.; Kevin M. Thill, Kenosha, Wis.; Christopher N. Kurby, Elmhurst, Ill.

[73] Assignee: Motorola, Inc., Schaumburg, Ill.

[21] Appl. No.: 517,520

[22] Filed: Aug. 21, 1995

[51] Int. Cl.[6] ..... H01Q 9/04

[52] U.S. Cl. ..... 343/790; 343/702; 343/791; 343/792; 343/895

[58] Field of Search ..... 343/729, 730, 343/790, 792, 895, 702, 791

[56] References Cited

U.S. PATENT DOCUMENTS

| | | | |
|---|---|---|---|
| 2,184,729 | 12/1939 | Bailey | 250/33 |
| 2,199,375 | 4/1940 | Lindenblad | 343/792 |
| 3,000,008 | 9/1961 | Pickles | 343/792 |
| 3,879,735 | 4/1975 | Campbell et al. | 343/792 |
| 4,352,109 | 9/1982 | Reynolds et al. | 343/792 |
| 4,410,893 | 10/1983 | Griffee | 343/792 |
| 4,433,336 | 2/1984 | Carr | 343/728 |
| 4,509,056 | 4/1985 | Ploussios | 343/791 |
| 4,725,846 | 2/1988 | Hendershot | 343/792 |
| 4,937,588 | 6/1990 | Austin | 343/790 |
| 4,963,879 | 10/1990 | Lin | 343/792 |
| 5,349,365 | 9/1994 | Ow et al. | 343/895 |

OTHER PUBLICATIONS

S. Egashira et al., "A Design of AM/FM Mobile Telephone Triband Antenna", *IEEE Transactions on Antennas and Propagation*, vol. 42, No. 4, Apr. 1994, pp. 538–545.

*Primary Examiner*—Donald T. Hajec
*Assistant Examiner*—Tho Phan
*Attorney, Agent, or Firm*—Daniel W. Juffernbruch

[57] ABSTRACT

A dual function antenna structure transceives in first and second modes. A first feed (120) feeds a primary antenna element (110) for operation in the first mode. A second feed (240) connects to the first feed (120). An upper choke (150) and a metal layer (160) are tuned to a wavelength of the radio frequency energy to be transceived in the second mode. The primary antenna element (110) and the metal layer (160) thus realize a secondary antenna element for operation in the second mode. In a portable radio, dual function operation is thus possible by a compact structure by the first and second feeds (120, 140).

17 Claims, 2 Drawing Sheets

DUAL FUNCTION ANTENNA STRUCTURE AND A PORTABLE RADIO HAVING SAME

BACKGROUND OF THE INVENTION

1. Technical Field of the Invention

The present invention relates to a dual function antenna structure and, more particularly, relates to a primary antenna element which resembles a secondary antenna element when operating in a second mode.

2. Description of the Related Art

Portable electronic radio equipment are typically desired for their small size and portable convenience. Typically, a single small antenna structure, such as a telescoping dipole or monopole antenna, is common. Nevertheless, these and other known antennas accommodate only one mode of operation. For example, these antennas are not optimized to resonate at two different radio frequencies.

Furthermore, these antennas accommodate radio frequency energy of only one type of polarization. For example, the telescoping monopole antenna of a typical cellular radiotelephone today accommodates only linearly polarized radio frequency energy. Compact antenna structures capable of providing a dual function of selected linearly polarized and circularly polarized radio frequency energy are unknown in the art.

DETAILED DESCRIPTION OF THE PREFERRED EMBODIMENTS

Figure 1:
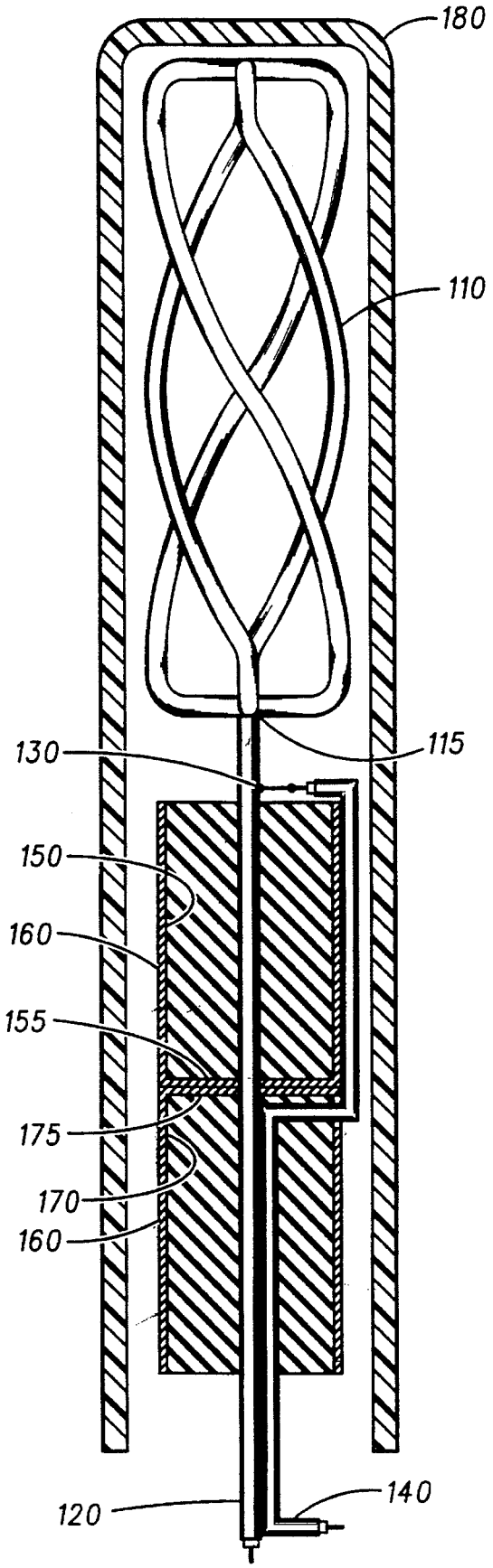
FIG. 1 illustrates a side view of a dual function antenna structure of an embodiment.

FIG. 1 illustrates a side view of a dual function antenna structure according to a first embodiment of the present invention. A primary antenna element 110 is fed by a first feed 120 for operation in a first mode. The primary antenna element is preferably a quadrifilar helix for circularly polarized radiation in the first mode. A second feed 140 connects to the first feed at a connection point 130. In the second mode, the metal layer 160 and the primary antenna element 110 are energized by the second feed 140 and functionally resemble a secondary antenna element in the second mode. An upper choke 150 is positioned immediately below the connection point 130 and serves to prevent radio frequency energy in the second mode from traveling below the upper choke 150. A compact antenna structure capable of providing a dual function is thus provided. Furthermore, the quadrifilar helix of the primary antenna element functionally resembles both a linearly polarized antenna structure and a circularly polarized antenna structure.

The upper choke 150 has metal inside surfaces or walls and also has a shorted end 155. The upper choke 150 has an electrical length or resonant frequency characteristic equal to approximately one-quarter the wavelength of radio frequency energy to be transceived in the second mode. Thus the choke approximates a quarter-wave transmission line with a shorted end. The electrical length above the connection point 130 to top of the primary antenna element 110 should also be an odd integral multiple of approximately one-quarter of the wavelength of the radio frequency energy to be transceived in the second mode. The position of the upper choke 150 and of the connection point 130 thus affects the electrical length of the antenna structure in the second mode and can be adjusted for the desired wavelength in the second mode.

A lower choke 170 is provided below the upper choke 150. The lower choke 170 has a shorted end 175 and an electrical length also corresponding to an odd integral multiple of approximately one-quarter the wavelength of the radio frequency energy in the second mode. The lower choke 170 enhances pattern characteristics of the antenna and reduces attenuation of energy in the second mode for the antenna structure, but can be omitted if the energy without the lower choke is adequate in the second mode.

A conductive outer surface or metal layer 160 is provided as a partial radiator of the second antenna element in the second mode. The metal layer 160 extends around the upper choke 150 and downward around the optional lower choke 170. Preferably, the upper choke 150 is formed of a single metal wall material, thus forming both the metal layer 160 and the inside surface of the upper choke 150 from the same metal wall material. The metal layer 160 should extend downward an electrical length of an odd integral multiple of approximately one-quarter of the wavelength of the radio frequency energy in the second mode.

Both the upper choke 150 and the lower choke 170 are filled with a dielectric having a dielectric constant ($\epsilon_r$=4) four times the dielectric constant of air ($\epsilon_r$=1) in the preferred embodiment. Then, the sum of the physical lengths of upper choke 150 and the lower choke 170 will be the same as the physical length of the metal layer 160. However, each of the three will still have an electrical length of approximately one-quarter the wavelength of the radio frequency energy in the second mode. This is because the electrical length of each of the chokes 150 and 170 is doubled with a dielectric constant four times the dielectric constant of air. When the lower choke 170 is omitted, the upper choke 150 does not need to be filled with the dielectric and can extend the same full length as the outer metal layer 160. A construction of the antenna structure without the lower choke 170 will be illustrated and described further in conjunction with FIG. 2.

The primary antenna element 110, first feed 120, second feed 140 upper choke 150, lower choke 170 and metal layer 160 preferably are housed in a radome 180 to form the antenna structure. The radome 180 is an enclosed tube of dielectric material which protects the antenna elements and feeds from the external environment.

The first feed 120 and the second feed 140 preferably are coaxial lines having a hot center conductor and a ground outer conductor. The first feed 120 is preferably constructed of a semi-rigid metal coaxial material. The semi-rigid metal coaxial material has a metallic outer conductor insulated by a dielectric from a metallic center conductor. The energy of the primary antenna element 110 travels inside the semi-rigid metal coaxial material of the first feed 120 on first and second surfaces. The first and second surfaces inside of the semi-rigid metal coaxial material are, respectively, the metallic center conductor and the inside skin of the metallic outer conductor. The metallic outer conductor of the semi-rigid coaxial material has a third surface. The third surface is the outside skin of the metallic outer conductor.

The quadrifilar helix of the primary antenna element 110 of the first embodiment is preferably constructed using the semi-rigid metal coaxial material. At a short point 115, the third surface on the outside of the semi-rigid coaxial material of the first feed 120 and the four arms of the quadrifilar helix of the primary antenna element 110 are shorted.

When the antenna structure operates in the second mode through the second feed 140, energy from the hot center conductor of the second feed 140 is connected at the connection point 130 to the third surface on the outside skin of the metallic outer conductor of the first feed 120 and the primary antenna element 110. The above coaxial inner and outer conductor connections are preferred in this embodiment; nevertheless, other constructions are possible. The connection from the hot center conductor of the second feed 140 to the connection point 130 is preferably a direct electrical connection which may have an inherent parasitic capacitance or inductance introduced for manufacturing reasons. A deliberate reactive impedance component at the connection point 130 may be introduced. One advantage of introducing a reactive impedance component into the connection at point 130 would be to form a matching circuit. A capacitive matching circuit would allow the upper choke 150, for example, to have a slightly shorter height.

The second feed 140 is preferably connected to the metal layer 160. The connection of the ground outer conductor of the second feed 140 to the metal layer 160 is preferably a direct electrical connection which may have an inherent parasitic capacitance or inductance introduced for manufacturing reasons. The ground outer conductor of the second feed 140 does not need to be deliberately connected to the metal layer 160 if lower performance of the antenna can be tolerated. When using the lower choke 170, the second feed 140 can be snaked into the lower choke 170 to further enhance pattern characteristics of the antenna and reduce attenuation of energy in the second mode.

A secondary antenna element capable of transceiving linearly polarized radio frequency energy is thus achieved by the outer surfaces of the first feed 120, the metal layer 160 and the quadrifilar helix of the primary antenna element 110. Because the quadrifilar helix of the primary antenna element also transceives circularly polarized radio frequency energy at the first wavelength, the dual functions of transceiving circularly polarized radio frequency energy in one mode and linearly polarized radio frequency energy in another mode are accomplished.

A dual function antenna structure is desired for a compact dual mode portable radio. For example, terrestrial or land-based cellular radio systems typically use linearly-polarized radio energy. Portable satellite radios, on the other hand, typically need to employ circularly polarized antennas. Circularly polarized antennas have a better gain pattern for receiving and transmitting energy towards the zenith to sources in outer space rather than linearly polarized antennas. Linearly-polarized antennas have a better gain pattern for transmitting and receiving energy towards the horizon to terrestrial base stations. A single antenna structure capable of operating in both a linearly-polarized mode and a circularly-polarized mode is thus provided by the present invention. Compact portable, dual mode satellite and terrestrial radio receivers are thus possible using a single antenna structure by the present invention.

Figure 2:
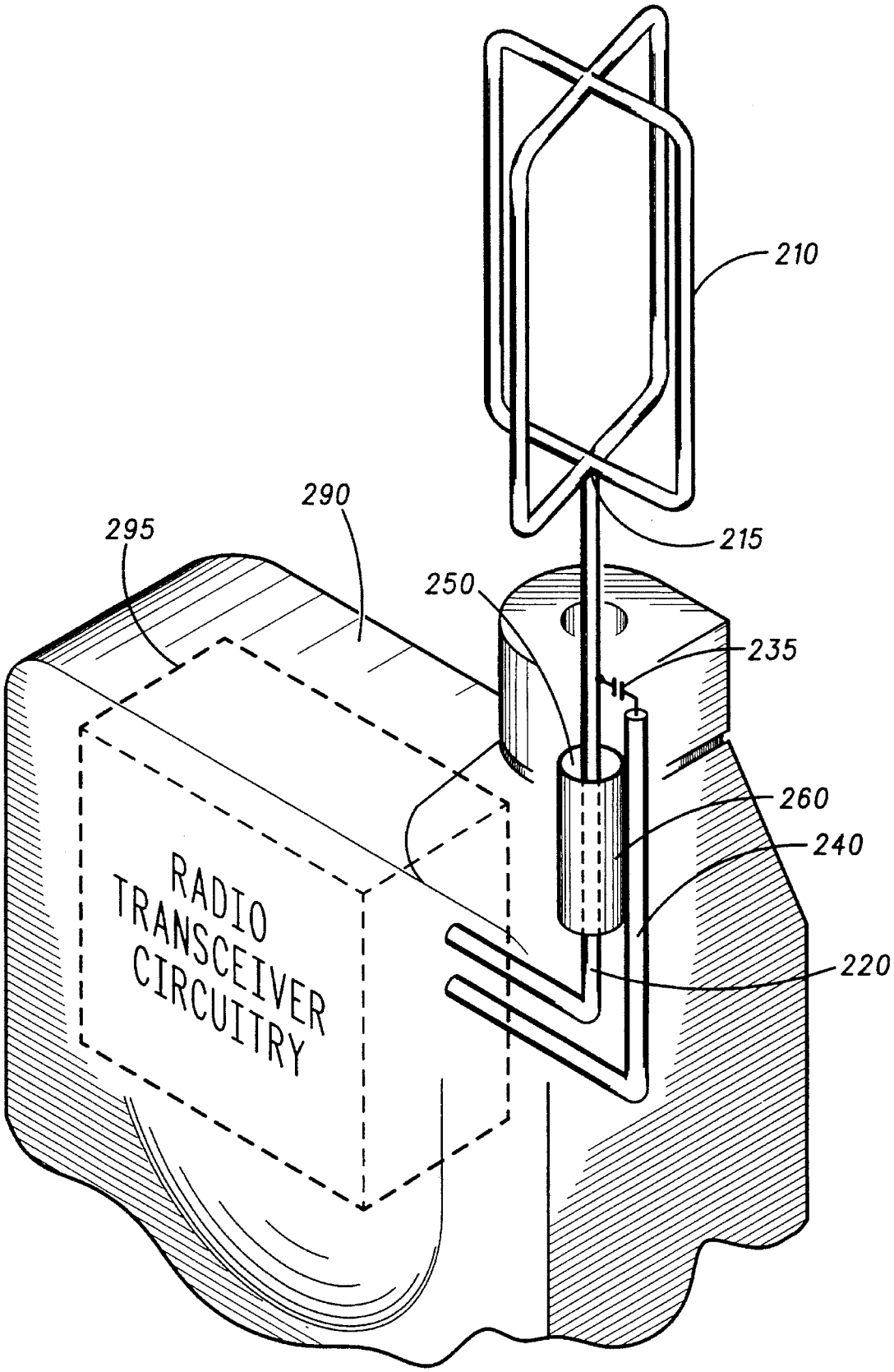
FIG. 2 illustrates a perspective view of a portable radio with a dual function antenna structure according to another embodiment.

FIG. 2 illustrates a portable radio 290 having a compact single antenna structure and dual function capability. A first feed 220 connects a first mode output of radio circuitry 295 to a primary antenna element 210. An upper choke 250 is provided coaxial to the first feed 220. A cross loop without the twist of a quadrifilar helix is illustrated for the primary antenna element 210. A second feed 240 connects a second mode output of radio circuitry 295 at a connection point 230 to the first feed 220 and a metal layer 260. A reactive inductance such as a capacitor 235 can be provided in the second feed. The connection point 230 could be positioned at or below a short point 215 of the primary antenna element 110 but above the top of the upper choke 250.

Although the invention has been described and illustrated in the above description and drawings, it is understood that this description is by example only and that numerous changes and modifications can be made by those skilled in the art without departing from the true spirit and scope of the invention. For example, the metal layer 160 or 260 can be provided separately or on surfaces other than an outside surface of the choke. Multiple function antenna structures having three or more modes may also be accommodated by employing three or more feeds and a plurality of respective chokes. Although the antenna structure realized a compact portable radio, the antenna structure can be used with mobile radios or fixed location radios.

What is claimed is:

1. A dual function antenna structure for transceiving a first signal at a first wavelength and a different second signal at a second wavelength, comprising:

a primary antenna element capable of transceiving at the first wavelength;

at least one choke coupled to the primary antenna element and capable of choking at the second wavelength;

a first coaxial feed disposed within the choke and having a center conductor, an inner skin and an outer skin, wherein the center conductor and the inner skin of the first coaxial feed are electrically connected to the primary antenna element to feed therein the first signal having the first wavelength;

a conductive outer surface covering a perimeter of the choke and extending from a second signal connection location in a direction opposite the primary antenna element; and a second feed comprising a first conductor and a second conductor, wherein the first conductor is operatively coupled to the outer skin of the first coaxial feed at the second signal connection location between the primary antenna element and the choke to feed therein the second signal having the second wavelength and wherein the second conductor is operatively connected to the conductive outer surface covering the perimeter of the choke so that at least both the conductive outer surface and the primary antenna element form a secondary antenna element for transceiving the second signal at the second wavelength.

2. A dual function antenna structure according to claim 1, wherein the second feed is connected to the first coaxial feed at a location a distance below a top of the primary antenna element equal to an electrical length of an odd integral multiple of approximately one-quarter of the second wavelength of the second signal.

3. A dual function antenna structure according to claim 2, wherein the conductive outer surface has an electrical length an odd integral multiple of approximately one-quarter the second wavelength of the second signal.

4. A dual function antenna structure according to claim 1, wherein the secondary antenna element is a linearly polarized antenna element for transceiving a linearly polarized second signal.

5. A dual function antenna structure according to claim 4, wherein the primary antenna element comprises a circularly polarized antenna element for transceiving a circularly-polarized first signal.

6. A dual function antenna structure according to claim 5, wherein the circularly polarized antenna element comprises a quadrifilar helix antenna element.

7. A dual function antenna structure according to claim 1, wherein the choke comprises a transmission line having a shorted end with an electrical length an odd integral multiple of approximately one-quarter the second wavelength.

8. A dual function antenna structure according to claim 1, wherein the second signal feed is directly connected to the first coaxial feed at the second signal connection location between the primary antenna element and the choke.

9. A dual function antenna structure according to claim 1, wherein the second signal feed is reactively coupled to the first coaxial feed at the second signal connection location between the primary antenna element and the choke.

10. A dual function antenna structure according to claim 9, wherein the second signal feed is capacitively coupled to the first coaxial feed at the second signal connection location between the primary antenna element and the choke.

11. A dual function antenna structure according to claim 1, further comprising another choke capable of choking at the second wavelength of the second signal.

12. A dual function antenna structure according to claim 11, wherein the another choke comprises a transmission line having a shorted end with an electrical length an odd integral multiple of approximately one-quarter the second wavelength of the second signal.

13. A dual function antenna structure according to claim 11, wherein the conductive outer surface covers a perimeter of both the choke and the another choke.

14. A dual function antenna structure according to claim 13, wherein the conductive outer surface has an electrical length an odd integral multiple of approximately one-quarter the second wavelength of the second signal.

15. A dual function antenna structure according to claim 11, wherein the conductive outer surface is formed by outer surfaces of both the choke and the another choke.

16. A dual function antenna structure according to claim 1, further comprising radio circuitry capable of transceiving the first signal in a first mode and the second signal in a second mode, a first mode output of the radio circuitry coupled to the first coaxial feed and a second mode output of the radio circuitry coupled to the second feed.

17. A portable radio having a dual function antenna structure for transceiving a first signal at a first wavelength and a different second signal at a second wavelength, comprising:

a primary antenna element capable of transceiving at the first wavelength in a first mode;

at least one choke coupled to the primary antenna element and capable of choking at the second wavelength in a second mode;

a first coaxial feed disposed within the choke and having a center conductor, an inner skin and an outer skin, wherein the center conductor and the inner skin of the first coaxial feed are electrically connected to the primary antenna element to feed therein the first signal having the first wavelength;

a conductive outer surface covering a perimeter of the choke and extending from a second signal connection location in a direction opposite the primary antenna element;

a second feed comprising a first conductor and a second conductor, wherein the first conductor is operatively coupled to the outer skin of the first coaxial feed at the second signal connection location between the primary antenna element and the choke to feed therein the second signal having the second wavelength and wherein the second conductor is operatively connected to the conductive outer surface covering the perimeter of the choke so that at least both the conductive outer surface and the primary antenna element form a secondary antenna element for transceiving the second signal in the second mode at the second wavelength; and radio circuitry capable of operating in the first mode and in the second mode, a first mode output of the radio circuitry coupled to the first coaxial feed and a second mode output of the radio circuitry coupled to the second feed.

* * * * *